United States Patent [19]

Lena

[11] 4,362,158

[45] Dec. 7, 1982

[54] SYNTHETIC BAG-TYPE CONTAINER FOR HUMAN BLOOD AND ITS FRACTIONS, PERFUSION SOLUTIONS, DIALYSIS SOLUTIONS AND ALIMENTARY AND CHEMICAL LIQUIDS IN GENERAL

[76] Inventor: Paolo Lena, Via Castello, 13, 26038 Torre de'Picenardi (Cremona), Italy

[21] Appl. No.: 197,225

[22] Filed: Oct. 15, 1980

[30] Foreign Application Priority Data

Jan. 22, 1980 [IT] Italy ..... 34810/80[U]

[51] Int. Cl.[3] ..... A61J 1/00

[52] U.S. Cl. ..... 128/272; 128/214 D; 128/DIG. 24

[58] Field of Search ..... 128/214 D, 272, DIG. 24, 128/213 R, 213 A; 150/8; 206/804, 69, 828

[56] References Cited

U.S. PATENT DOCUMENTS

| | | | |
|---|---|---|---|
| 3,915,212 | 10/1975 | Bujan et al. | 128/214 D |
| 3,926,341 | 12/1975 | Lhoest | 128/214 D |
| 4,212,299 | 7/1980 | Yokokoji et al. | 128/214 D |

*Primary Examiner*—Richard J. Apley
*Assistant Examiner*—T. J. Wallin
*Attorney, Agent, or Firm*—Brisebois & Kruger

[57] ABSTRACT

A synthetic bag-type container for human blood and its fractions, and perfusion solutions in general, is constituted by an envelope welded on three sides, with the fourth side configured as a bellows to generate the base of the container, from which the delivery nozzles project, each end of the bellows being defined by two inclined welds which converge into the adjacent lateral weld of the envelope, so as to give the base a concave configuration which ensures perfect emptying of the contents.

12 Claims, 4 Drawing Figures

Fig.2.
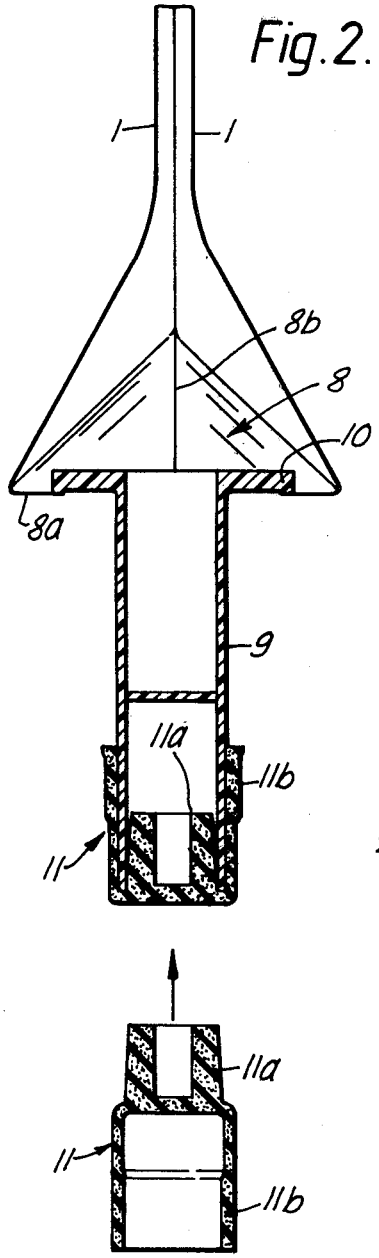
Fig.3.
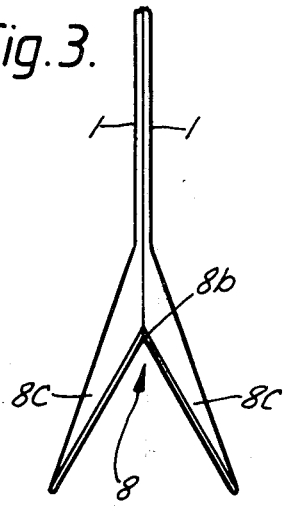
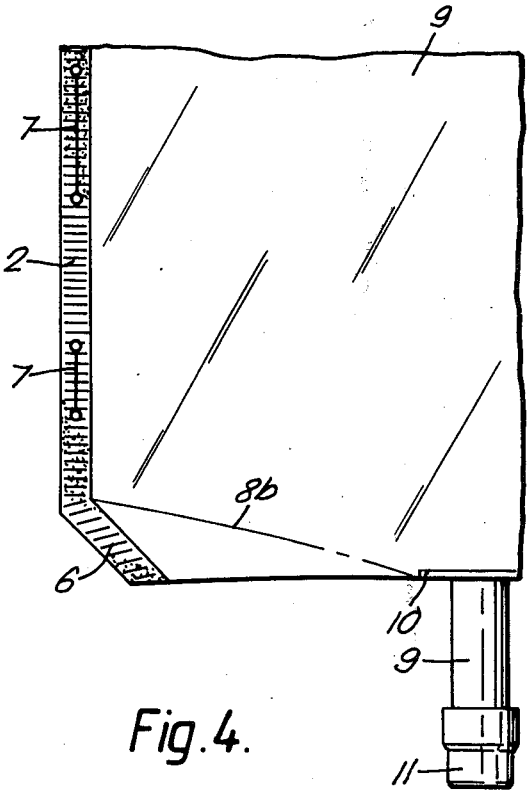
Fig.4.

SYNTHETIC BAG-TYPE CONTAINER FOR HUMAN BLOOD AND ITS FRACTIONS, PERFUSION SOLUTIONS, DIALYSIS SOLUTIONS AND ALIMENTARY AND CHEMICAL LIQUIDS IN GENERAL

SUMMARY OF THE INVENTION

This invention relates to a synthetic bag designed to contain in particular medical liquid products such as human blood and its fractions, dialysis solutions, perfusion solutions, chemical and alimentary liquids and the like, which is constituted in such a manner that when it is suspended it allows complete or total delivery of its contents.

Bag-type containers are already known in the prior art for the aforesaid purposes.

Bags are known inter alia which are essentially constituted by two overlying stratified synthetic sheets of any dimensions and configuration, which are welded perimetrally together such that when the container is not being used, it assumes a completely flat configuration.

However, although these types of container suitably satisfy the technological, chemical and biological requirements of the uses for which they are intended, they have a serious operational drawback in that it is not possible to completely empty them.

This derives firstly from the fact that the inner mouth of the normal delivery nozzles of which said known bags are provided are disposed at a certain distance from the inner limit of the corresponding end weld, and secondly from the fact that two "passive" zones are present to the sides of the nozzles, i.e. in positions corresponding with the opposing terminal parts of said end weld, these passive zones forming two parts of the bag which tend both not to be occupied by the liquids during filling, and to retain part of the contents during emptying.

Consequently, only part of the available volume in the container is occupied by the liquid, and undesirable air pockets can remain in the presence of said liquid.

Moreover, the fact that it is impossible for the entire contents of the bag to be extracted and/or administered is of great importance, especially when it is necessary to administer a determined quantity, and only that quantity, of a particular substance, solution, organic liquid or the like.

A further disadvantage is the fact that after administration, known bags are thrown away, so resulting in loss of part of the contents which besides being of high cost can be rare or insufficiently available, or difficult to obtain, as is the case for example of the human blood and its fractions.

The main object of the present invention is to provide a bag-type container which obviates the aforesaid drawbacks.

According to the invention, this object is attained by providing in the delivery zone of a bag-type container, an "active" element in the sense that it precipitates in conveying the bag contents towards the delivery zone where convenient nozzles are provided.

The aforesaid "active" element provides a surface which constitutes the actual base of said delivery zone, and also acts as the connection zone for the delivery nozzles in such a manner as to advantageously allow the complete or total filling and emptying of the bag-type container.

According to the invention, the aforesaid "active" element is in the form of a bellows, the central zone of which acts as the connection wall for the nozzles, while its opposing ends comprise two single folds which project towards the interior of the container and which individually define two side-by-side dihedrals which converge at the crest of the corresponding single fold, said crest being smoothly connected to the aforesaid central zone.

The nozzles are advantageously formed of the same material which defines the interior of the bag, to which they are connected by means of a collar.

Finally, the free end of each nozzle is hermetically sealed by a reversible plug to ensure sterility of the contents, this plug being able to be perforated by a needle in order to enable the container to be filled and emptied without liquid loss and without the risk of accidental contamination.

The objects and advantages of the invention, together with its characteristics and constructional merits will be more apparent from the detailed description given hereinafter with reference to the figures of the accompanying drawings in which:

FIG. 2 is a section on the line II—II of FIG. 1;

FIG. 3 is an end section through the bellows with which the invention is provided;

FIG. 4 is a partial projection in plan of the terminal part of the bag where said bellows is provided.

Figure 1:
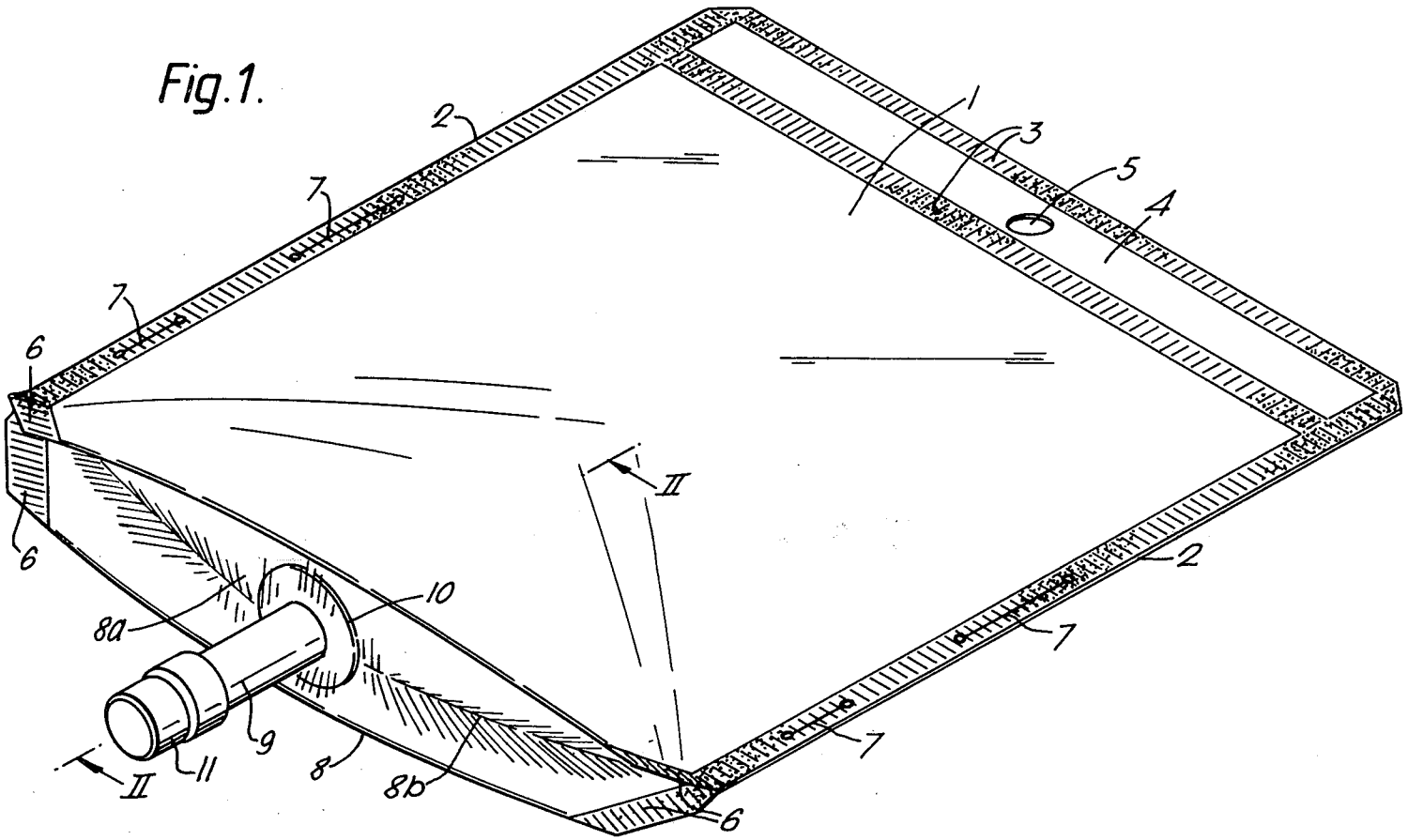
FIG. 1 is a perspective view of a container according to the invention.

From said figures, and in particular FIG. 1, it can be seen that the container according to the invention is essentially constituted by a bag of practically rectangular shape, which is formed from a single film-type sheet of synthetic material, as will be more apparent hereinafter.

The longitudinal and transverse dimensions of said film-like sheet can be chosen according to the capacity required for the container.

Said film-like sheet is produced from a continuous web of convenient width. In addition, the continuous starting web can be of the single or double layer type.

A single layer film-type sheet could consist of a polyethylene, polypropylene or polyethylene-butyl rubber copolymer film.

According to the uses of the bag-type container deriving from said single layer film, this latter would have a thickness of the order of 80–150 microns.

The initial film web for the present container can consist of a stratified film comprising a polyethylene, polypropylene or polyethylene-butyl rubber copolymer film, and a nylon or polyester film, these being securely cemented together.

In this case, the thickness of the nylon or polyester film would lie between 10 and 30 microns, while the thickness of the remaining film designed to constitute the interior of the container would have a value as stated heretofore.

As stated in the aforesaid application, said materials have high physical, chemical, thermal and mechanical characteristics.

The most important characteristics of the container according to the invention constructed with the aforesaid materials can be briefly summarised in that it is chemically stable, is transparent and flexible, is resistant to torsion, to traction and pressure, is impermeable to air and microorganisms, is impermeable to water vapour, is thermally stable at both high and low temperatures, can be easily filled and emptied, is hydro and hemorepellent, can be preserved with time and centrifuged, is apyretic, i.e. does not contain fever-generating substances, and finally does not react chemically with the liquids which it contains, it cannot make them toxic, and has complete biological compatibility with human red corpuscles.

The container according to the invention is composed of two side walls 1 connected together by two longitudinal welds 2. These latter, together with the welding lines which will be described hereinafter, can be produced either by hot welding with teflon-coated electrodes, or by ultrasonic welding.

At one end of the container, namely at that end from which it is intended to be suspended during the delivery of its contents, two transverse weld lines 3 are provided, spaced apart so that together with the corresponding terminal portions of the longitudinal welds 2, they define a transverse flap 4.

A suspension hole 5 is provided in the central zone of this latter.

In a central position in each longitudinal weld 2 and parallel thereto, there is provided a pair of cuts or slots 7, one of which occupies the middle longitudinal zone of the corresponding weld whereas the other is located in that end thereof distant from the zone occupied by the flap 4.

That end of the container distant from the flap 4 is constituted by a bellows 8 which defines the base of the invention. Said bellows 8 is formed from the initial synthetic sheet, and two side walls 1 extend from it.

Each of the panels of the bellows 8 and the respective adjacent side wall 1 are joined together at their edges by an oblique weld 6.

In this manner, the bellows 8 is divided into a base or connection wall 8*a* which constitutes the central zone of the bellows, and a pair of opposing zones 8*b* which lie between the side walls 1 and converge towards the inner central zone of the bag.

The accompanying FIGS. 2 and 3 clearly show the base wall 8*a* and the zones 8*b* of the bellows 8.

Two adjacent dihedrals 8*c* are thus defined, which converge towards the crest of the zone 8*b* which is connected to the flat central wall 8*a*, this being practically orthogonal to the side walls 1.

A delivery nozzle 9 is connected by means of a collar 10 to the inner face of the connection wall 8*a* of the bellows 8, this latter constituting the delivery zone of the invention.

Only one nozzle has been shown on the accompanying drawing for reasons of clarity and simplicity, but usually the invention will comprise two or more. These latter are fitted by welding, as stated heretofore.

The delivery nozzles 9 are advantageously constructed of the same material as the interior of the bag, i.e. polyethylene, polypropylene or polyethylene-butyl rubber copolymer. Furthermore, said nozzles are rigid, and are formed by moulding.

As shown in FIG. 2, a plug 11 of natural of synthetic rubber-based elastomer material is provided for the free end of each nozzle, and consists of a central sealing member 11*a* and a reversible cylindrical skirt 11*b*. The purpose of these latter is to close the corresponding nozzle and to enclose the outside of the free end of it respectively.

Although the nozzles 9 have been designated as delivery nozzles heretofore, it is apparent that they, or some of them, can be in the form of filling, connection and transfer nozzles.

Especially for connection and transfer purposes, it is extremely advantageous to arrange the requisite nozzle or nozzles at the transverse edge of that end of one of the side walls 1 which is immediately adjacent to the bellows 8.

The characteristics of the container will be more apparent from the following description of one possible method for its formation.

Starting from a roll of synthetic single or double layer strip of suitable width, a plurality of equal sheets is cut, of length corresponding to the required capacity for the final bag.

Each sheet is then folded to constitute the two side walls 1.

The bellows 8 is then constructed at said transverse fold.

The oblique welds 6 are made simultaneously with this operation. After this, the longitudinal welds 2 are made. The central part 8*a* of the bellows 8 is then perforated, and the nozzles 9 are inserted into the holes thus formed, from the inside of the container by way of that end which is still open. The collars 10 of the nozzles 9 are then hermetically welded, in the manner heretofore described, to the inner surface of the connection wall 8*a*.

The two transverse weld lines 3 are then formed in order to complete the formation of the bag, their purpose being to construct the flap 4 in which the central hole 9 is then provided.

The cuts or slots 7 along the longitudinal welds 2 are formed during the aforesaid operations.

Finally, having attained the configuration shown in FIG. 2, the central sealing member 11*a* of the corresponding plug 11 is inserted into each nozzle.

The cylindrical skirts 11*b* are then reversed so that they enclose and make contact with the free ends of the nozzles 9.

The bag-type container thus formed is hermetically sealed, is internally free from atmospheric air residues, and is ready for filling.

Although not previously stated and/or shown, it should be noted that the plugs 11 can each be covered with a further protective plastic cover.

From the detailed description given, it will be apparent that the purpose of the through bore 5 is to suspend the invention during the delivery, connection and/or transfer stages.

The nozzles 9 represent the elements through which filling, connection, transfer and delivery are carried out.

With reference to the filling and emptying of a container formed in this manner, the great advantage deriving from the resilient plugs 11 must be emphasised. These can be perforated with a needle in order to allow said filling and emptying without any leakage or loss of liquid (contents), and without any risk of accidental contamination of said contents.

The cuts or slots 7 represent means for fixing the bag-type container according to the invention to the normal centrifuge bowls, when necessary.

It is apparent that the greatest merit of the invention is the presence of the bellows 8, to the central part 8*a* of which are connected the nozzles 9, thus enabling the bag to be filled and then completely emptied during delivery or transfer of the contents.

This complete emptying is due to the fact that when the bag is suspended, the central part of the bellows and the nozzle fixing collars become disposed practically horizontal, and further to the fact that said central part because of the overlying weight tends to sag downwards along two orthogonal directions, so facilitating the flow of the contents towards the collars, and again to the fact that the inner zones 8*b* constituting the opposing ends of the bellows 8 greatly aid this flow because of their inclined plane configuration.

As already stated in the initial part of the present description, it is apparent that although the proposed container is particularly suitable for human blood, its fractions, perfusion solutions and dialysis solutions, it is also suitable for other uses such as containing alimentary liquid products, chemical liquids or solutions, and other products.

What is claimed is:

1. A generally flat synthetic bag-type container for human blood and its fractions, perfusion solutions, dialysis solutions and alimentary and chemical liquids in general, constituted by a thin flexible walled casing which is in the form of a rectangular envelope having a bellows-shaped base and comprised of a single thin, pliable synthetic film sheet, and which is hermetically closed by welding along three edges of its perimeter while on its remaining edge at its base there is provided, integral with the sheet, a bellows facing towards the interior of the casing, said bellows having a central zone, of which there branches a nozzle set sealed to and extending from said central zone, each nozzle being provided with a resilient sealing member; and means along said three welded edges for supporting said casing.

2. A container as claimed in claim 1, wherein said bellows is in the form of a flexible wall defined by a central part of the initial film sheet and composed of a flat central zone essentially orthogonal to the lie of the casing, opposite ends of said bellows having two inner zones inclined towards the central zone.

3. A container as claimed in claim 1, wherein said bellows is defined by four oblique lateral welds, one for each panel of the bellows, and which terminate at the two welds along the two parallel side edges of the container.

4. A container as claimed in claim 1, particularly for containing solutions and liquids in general, wherein said initial film sheet is of the single-layer type, and is constituted by polyethylene-butyl rubber copolymer, polyethylene or polypropylene.

5. A container as claimed in claim 1, wherein the initial film sheet has a thickness of 80–150 microns.

6. A container as claimed in claim 1, wherein said initial film sheet is of the stratified type, and comprises a film of polyethylene, polypropylene or polyethylene-butyl rubber copolymer, and a film of nylon or polyester, which are securely cemented together and of which the former constitutes the interior of the container.

7. A container as claimed in claim 1 constituted by a stratified film sheet, wherein the inner film of said initial film sheet has a thickness of 80–150 microns, while the outer film of said initial film sheet has a thickness of 10–30 microns.

8. A container as claimed in claim 1, wherein each of the delivery and filling nozzles is tubular, and is hermetically welded to the inner face of the flat central zone of the bellows by way of a collar.

9. A container as claimed in claim 1, wherein said nozzles are constructed of the same material as the single-layer film which constitutes the casing.

10. A container as claimed in claim 1, wherein the nozzles are constructed of the same material as the most inner layer of the multi-layer film constituting the casing.

11. A container as claimed in claim 1, wherein the resilient sealing member of each individual nozzle is in the form of a plug of elastomer material which comprises a central part for insertion into the free end of the corresponding nozzle and arranged to be perforated by a needle, and a reversible cylindrical skirt arranged to externally enclose said free end when the central part is inserted into the nozzle.

12. A container as claimed in claim 1, wherein the means for suspending the casing comprise an upper hole provided in an upper strengthened zone, and two cuts or slots on each side, formed along each side weld of the bellows.

* * * * *